US005509609A

United States Patent [19]

Kamler

[11] Patent Number: 5,509,609

[45] Date of Patent: Apr. 23, 1996

[54] SLUDGE LANCE NOZZLE

[75] Inventor: Frank Kamler, Ontario, Canada

[73] Assignee: The Babcock & Wilcox Company, New Orleans, La.

[21] Appl. No.: 335,922

[22] Filed: Nov. 8, 1994

Related U.S. Application Data

[63] Continuation of Ser. No. 154,194, Nov. 17, 1993, abandoned.

[51] Int. Cl.[6] ..... B08B 9/02

[52] U.S. Cl. ..... 239/461; 239/590; 239/DIG. 13; 122/392; 134/167 C

[58] Field of Search ..... 134/167 C, 166 C, 134/168 R, 168 C; 15/316.1; 239/DIG. 13, 461, 553, 590; 122/390, 391, 392

[56] References Cited

U.S. PATENT DOCUMENTS

| | | | |
|---|---|---|---|
| 1,048,004 | 12/1912 | Strebig | 239/461 |
| 1,568,250 | 1/1926 | Stanton | 239/590 X |
| 1,795,807 | 3/1931 | Terry | 239/461 |
| 4,764,180 | 8/1988 | Shaddock | 239/DIG. 13 |
| 5,241,723 | 9/1993 | Garrabrant | 239/DIG. 13 X |
| 5,271,356 | 12/1993 | Kling et al. | 239/461 X |

FOREIGN PATENT DOCUMENTS

| | | | |
|---|---|---|---|
| 1657229 | 6/1991 | U.S.S.R. | 239/461 |

*Primary Examiner*—Kevin P. Weldon
*Attorney, Agent, or Firm*—Daniel S. Kalka; Robert J. Edwards

[57] ABSTRACT

The Applicant's present invention is drawn to an improved nozzle for a miniaturized sludge lance intended to be used with an articulated sludge lancing systems to clean narrow tube lanes. The improved nozzle has an internal flow straightener which minimizes turbulence within the nozzle and allows a pair of oppositely located nozzles to be fitted within the miniature lance while producing the output cleaning power of nozzles requiring dimensioning that would not fit within the confines of the miniature lance assembly.

6 Claims, 2 Drawing Sheets

SLUDGE LANCE NOZZLE

This is a continuation of application Ser. No. 08/154,194, filed Nov. 17, 1993, now abandoned.

BACKGROUND OF THE INVENTION

1. Field of the Invention

The present invention relates, in general, to equipment for cleaning steam generators and, in particular, to sludge lance nozzles used in articulated fluid sludge lances used to clean boiler tube lanes from the annular openings found in such boilers.

2. Description of the Related Art

In nuclear power stations, steam generators, such as recirculating steam generators and once-through steam generators, are used for heat exchange purposes to generate steam which drives turbines. Primary fluid is heated in the core of the nuclear reactor and passed through a bundle of tubes in the steam generator. Secondary fluid, generally water, is fed into the space surrounding the tubes and receives heat from the tubes converting the water into steam for driving the turbines. After cooling and condensation has occurred, the secondary fluid is directed back into the space around the tubes to provide a continuous steam generation cycle. Due to the constant high temperature and severe operating conditions, sludge accumulates on the lower portions of the tubes and on the tubesheet which supports same. The sludge is mainly comprised of an iron oxide, such as magnetite and reduces the heat transfer efficiency of the tubes as well as causing corrosion. Thus, the tubes must be cleaned periodically to remove the sludge. Various types of apparatus and methods are available to accomplish this task. The sludge buildup is extremely difficult to remove and concentrated high pressure fluid streams are used to remove this sludge using sludge lances from either a no-tube lane or annular opening of the boiler. Pressure of 8,000 p.s.i. at the spray nozzle, normal. This high pressure makes it imperative to use a balanced nozzle having identical nozzles at opposing ends of the lance to minimize stress on the equipment. Balanced flow nozzles are known and examples of same may be found in the following prior art references.

U.S. Pat. No. 4,980,120 entitled "Articulated Sludge Lance" assigned to the assignee of the present invention, and hereby incorporated by reference, discloses an articulated lance for cleaning sludge located between steam generator tubes. In operation, the lance is inserted through a handhole in the no-tube lane of the boiler.

U.S. Pat. No. 5,194,217 entitled "Articulated Sludge Lance with a Movable Extension Nozzle" is also assigned to the assignee of the present invention, and hereby incorporated by reference, it discloses an articulated sludge lance with a retractable movable extension nozzle.

In addition to those references, U.S. Pat. No. 4,407,236 to Schukei, et al discloses a thin strip of spring steel which enters a tube lane for sludge lance cleaning for nuclear steam generators. The forward ends of the capillary tubes located on the spring steel strips are directed downward for the jetting of fluid under high pressure.

U.S. Pat. No. 4,827,953 to Lee is directed to a flexible lance for steam generator secondary side sludge removal. This patent discloses a flexible lance having a plurality of hollow, flexible tubes extending lengthwise along the flexible member. There are a plurality of nozzles at an end of the flexible members with the flexible member being configured to go into the difficult to access geometry of the steam generator. The tight quarters of this particular type of lancing along with the need to provide an effective nozzle output which will remove the baked on sludge makes it difficult to provide an effective high pressure balanced nozzle assembly. Usually an effective nozzle takes up most of the allotted space for the lance making it impossible to provide two such nozzles in balanced opposition.

Thus, there is a need for an efficient balanced sludge lance nozzle for a sludge lancing apparatus which would effectively clean the tube lanes of a steam generator from any one of the access holes in a steam generator and especially lances entering from the annular chamber around the tubesheet of the boiler to clean the tubes therefrom.

SUMMARY OF THE INVENTION

The present invention solves the aforementioned problems associated with the prior art as well as others by providing an effective balanced sludge lance nozzle used in annular articulated sludge lances for cleaning a steam generator from the no-tube lane as well as the annular chamber or annulus surrounding the tube bundle of a steam generator.

To accomplish this aim, a flow straightener is added to the inlet of an elongated tapered lance nozzle. The nozzle flow straightener allows the main inlet body of the lance nozzle to be shortened by a factor of 2 or more while maintaining the same effectiveness as the longer nozzle thus allowing the placement of two opposing lance nozzles to be placed within the confines of the sludge lance to provide effective balanced flow from the lance for effective sludge removal from the boiler tubes.

The flow straightener includes a rectangular plate having a minimum length to width ratio of 2 to 1 which plate is inserted lengthwise along a preformed diameter of the nozzle inlet. The nozzle inlet diameter is approximately the same as the width of the rectangular plate which is press fit therein.

Accordingly, an object of the present invention is to provide an improved sludge lance nozzle assembly.

Another object of the present invention is to provide a sludge lance nozzle which will fit in a balanced flow relationship within a standard articulated lance assembly to provide improved balanced sludge removal.

Still a further object of the present invention is to provide a flow straightener for a standard sludge lance nozzle to produce improved sludge removal thereby.

For a better understanding of the invention, the operating advantages attained by its uses, reference is made to the accompanying drawings and descriptive matter in which a preferred embodiment of the invention is illustrated which is not to be construed as limiting the invention thereto.

DESCRIPTION OF THE PREFERRED EMBODIMENTS

Figure 1:
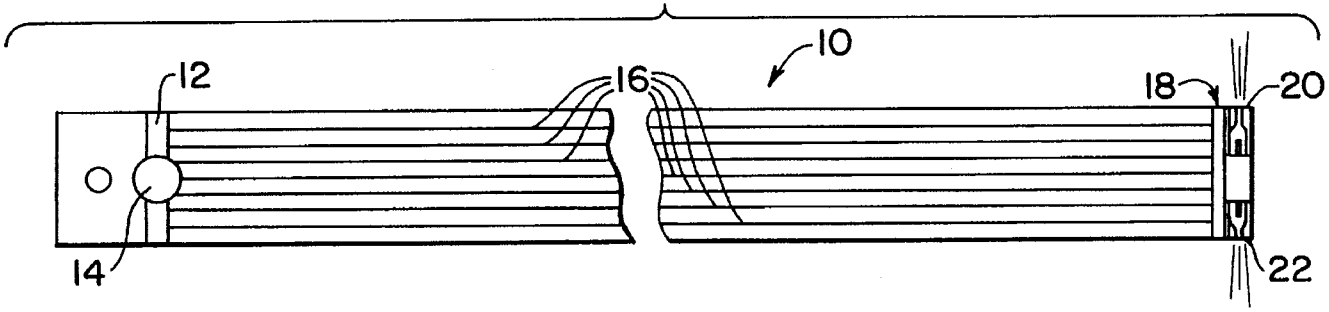
FIG. 1 is a side view of the sludge lance incorporating the improved nozzle balanced design of the present invention.

Referring to the figures generally, where like numerals designate like or similar features throughout the several drawings, and to FIG. 1 in particular, there is shown a modified fluid lance 10 which is intended to be used with an articulated sludge lance assembly of the type shown in U.S. Pat. No. 4,980,120 assigned to. The Babcock & Wilcox Company. This modified fluid lance is substantially rectangular in cross section and is intended to fit into the retaining cross sections of a manipulator (not shown) which feeds the lance 10 into the desired tube lane either from the no-tube lane or annular opening of the boiler.

The fluid lance 10 has a rear manifold 12 to which the fluid is supplied by way of a fluid inlet 14. The manifold 12 communicates with a plurality of longitudinally extending spaced apart fluid tubes 16 which communicate the fluid from the rear manifold 12 to a front manifold 18. The plurality of fluid tubes 16 may be of any desired number, however in the present situation seven such water tubes 16 having an outside diameter of approximately 0.084" and a wall thickness of 0.008" are provided. Normally water acting as the fluid is inputted into the fluid inlet 14 supplying the rear manifold 12 at approximately 10,000 p.s.i. pressure allowing the fluid lance to thus exhaust to identical oppositely located streams of fluid or water from the nozzles 20 and 22. With the exception of the modified nozzles 20 and 22, the construction of the lance 10 is identical to the lance described in the aforementioned U.S. Pat. No. 4,980,120.

To better appreciate the Applicant's present invention, the construction of the improved nozzles 20 and 22 will now be discussed.

Figure 3B:
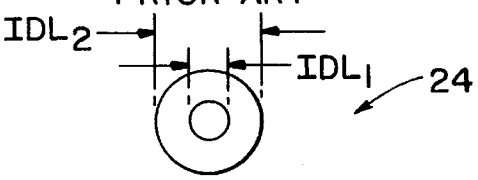
FIG. 3B PRIOR ART
FIG. 3*b* is an end view of the FIG. 3*a* prior art nozzle.
Figure 4B:
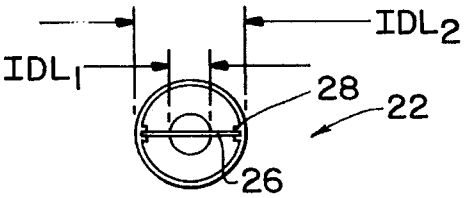
FIG. 4*b* is an end view of the nozzle of FIG. 4*a*.
Figure 4C:
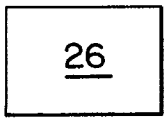
FIG. 4*c* is a top view of the flow straightener as seen incorporated in the nozzle of FIGS. 4*a* and 4*b*.
Figure 3A:
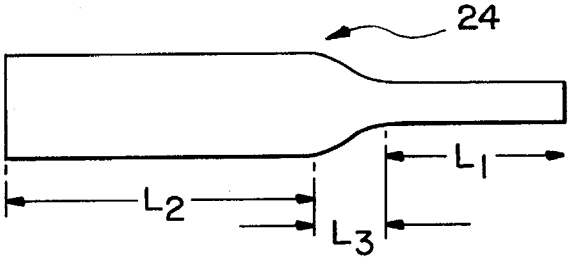
FIG. 3A PRIOR ART
FIG. 3*a* is a side view of a prior art nozzle without any internal flow straighteners.
Figure 4A:
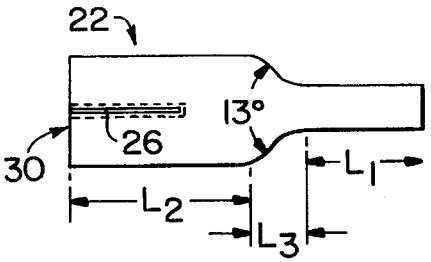
FIG. 4*a* is a side view of the nozzle of the present invention shown having an internal flow straightener.

Turning to the prior art FIGS. 3*a* and 3*b*, it will be noted that the lance 10 has to be very thin and relatively narrow so as to be able to fit within the narrow tube lane confines of the boiler and narrow in height so as to fit through the hand hole. The normal dimensions of the boiler prior art nozzles 24 had a inlet length $L_2$ of approximately ⅜" to ½". The nozzle 24 then tapered down at an included angle of approximately 13° at the $L_3$ area of the nozzle to form an elongated smaller diameter length $L_1$ orifice having a length of approximately ⅛". The inside diameter of the $L_2$ portion was approximately 0.072" while the inside diameter of the $L_1$ portion was approximately 0.040". Tests on this nozzle construction when located in the fluid lance 10 provided the following results. With an 8" standoff from a normal construction brick located under the bottom nozzle 22 of the lance 10 the lance was moved across the brick so as to traverse the width of the rectangular brick at a speed of 6" per minute. The pressure at the nozzle 22 was approximately 8,000 p.s.i. This prior art nozzle cut a groove in the brick under the foregoing conditions that was approximately ¼" deep and approximately ¼" wide.

It has been known by the Applicant that the performance of the nozzle is determined by the amount of turbulence and cavitation that will be found within the nozzle at this high pressure operation. Previous tests had shown that turbulence is somewhat minimized by maintaining the length to diameter ratio between $L_2$ and $IDL_2$ of approximately 8 to 1. That is the length $L_2$ must be at least eight times the diameter $IDL_2$. Also the included angle of the transition length $L_3$ located between $L_2$ and $L_1$ must be maintained at approximately 13° to maintain the proper width jet output from the nozzles 20 and 22. A larger transition angle loses the jet quality making the jet wide instead of the pencil line, quality type jet needed to clean the tubes in the narrow confines of the boiler lanes.

Attempts to increase the $L_2$to $IDL_2$ ratio in an attempt to further minimize turbulence and increase jet quality or cleaning power showed that when the length $L_2$ was increased to approximately sixteen times that of $IDL_2$, namely made to be approximately 1" long, a significant improvement in nozzle and lance performance was achieved. Running a test on the construction brick under the previously mentioned conditions with the only change made being the length $L_2$ of the nozzle at 1", it was found that the test brick was now cut to a depth of approximately ½" to ¾" as opposed to the ¼" cut depth with the previously mentioned shorter length nozzle, and the width of the cut remained at approximately ¼". However, this improved nozzle design having a 16 to 1 length to diameter ratio while providing minimized turbulence and increased cutting efficiency could not be incorporated into the fluid lance so as to have two balanced jets or nozzles 20 and 22 fitted therein. The increased $L_2$ dimensions of the nozzles provided insufficient space in the lance 10 to place them within the lance in balanced opposition so as to minimize stresses on the lance assembly.

Figure 2:
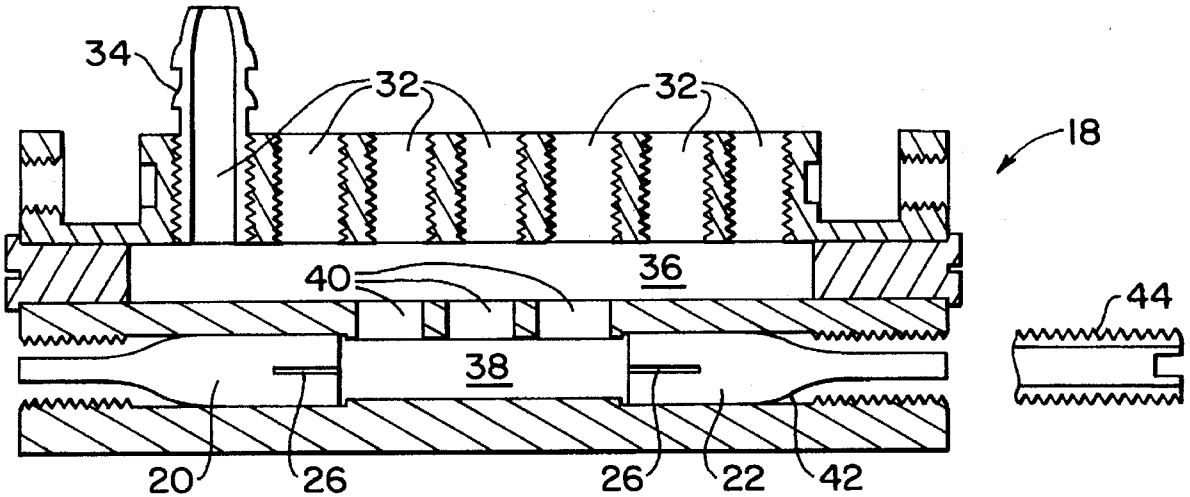
FIG. 2 is a side expanded view of the balanced nozzle assembly of the sludge lance shown in FIG. 1.

The Applicant upon experimentation found that he could achieve the same increased cutting efficiency as in the 16 to 1 ratio nozzles from the prior art 8 to 1 ratio nozzles by including a flow straightener 26 in the inlet to the $L_2$section of the nozzles. The flow straightener 26 is an approximately rectangular sheet of fully hardened stainless steel having a thickness of approximately 0.005". The surface finish of the flow straightener 26 is made to be as smooth as possible with normal EDM process manufacture. The flow straightener is approximately 0.125" long and is approximately 0.082" wide. As such the width of the flow straightener 26 is made to fit into a notched section 28 formed along a diameter of the $L_2$ portion of the nozzles 20 and 22. This notched section extends along the length $L_2$ for a distance of approximately 0.125" or the length of the flow straightener to thus place the straightener along the opening 30 to the $L_2$section of nozzles 20 and 22. Thus the dimensions of the tube nozzles 20 and 22 were the same as the aforementioned balanced prior art nozzles having a $L_2$ to $IDL_2$ ratio of approximately 8 to 1 and performed as well as the nozzles having a $L_2$ to $IDL_2$ratio of 16 to 1 which did not fit in balanced flow conditions within the confines of the fluid lance 10. Turning back to FIG. 2, it will be seen how the improved nozzles 20 and 22 are mounted within the front manifold 18 of the lance 10.

The front manifold 18 has seven openings 32 all of which connect to the seven fluid tubes 16 by having the ends of the tubes 16 pressed onto an extremely threaded anchor section 34 found threaded into each of the openings 32. The fluid from these tubes enters a mixing chamber 36 which feeds the nozzle chamber 38 through three openings 40 located between the nozzles 20 and 22. The nozzles 20 and 22 are located within annular sections 42 formed in the chamber 38 and are retained therein by screwed-in retainers 44 found at both ends of the chamber 38. The outputs from the nozzles 20 and 22 when used with the flow straighteners 26 thus can be located in balanced opposition within the manifold 18 to minimize stresses on the lance assembly 10 while providing the cutting efficiency of significantly longer length nozzles which would not fit within the confines of the lance assembly where the confines are dictated by the structure of the boiler and the tubes lane requiring sludge removal.

It will be understood that certain modifications and improvements have been deleted herein for the sake of conciseness and readability but are considered to within the scope of the following claims.

I claim:

1. An improved sludge lance nozzle, comprising:

a fluid inlet portion being circular and having a first length and diameter, said first length being approximately eight times said first diameter;

a fluid exhaust portion being circular and having a second length and diameter smaller than said first length and diameter;

a transition length between said fluid inlet portion and said fluid exhaust portion tapering said first diameter into said second diameter; and a single flow straightener mounted inside said fluid inlet portion to minimize turbulence therein and improve the output of said fluid exhaust portion thereby, said flow straightener including a rectangular plate inserted along said first diameter of said fluid inlet portion, the improved sludge lance nozzle constructed to be located within a front manifold of a sludge lance assembly.

2. An improved nozzle as set forth in claim 1, wherein said first diameter is approximately twice said second diameter.

3. An improved nozzle as set forth in claim 1, wherein said fluid is water supplied at approximately 10,000 p.s.i.

4. An improved nozzle as set forth in claim 1, wherein said first length is approximately ¼" and said second length is approximately ⅛".

5. An improved nozzle as set forth in claim 4, wherein said transition length is formed at approximately an included angle of 13°.

6. An improved nozzle as set forth in claim 5, wherein said first diameter is approximately 0.072" and said second diameter is approximately 0.040".

* * * * *